US006443784B1

(12) United States Patent
Kimoto

(10) Patent No.: US 6,443,784 B1
(45) Date of Patent: Sep. 3, 2002

(54) CONTACT AND CONTACT ASSEMBLY USING THE SAME

(76) Inventor: Gunsei Kimoto, 3-2-807, Daiba 1-chome, Minato-ku, Tokyo (JP)

( * ) Notice: Subject to any disclaimer, the term of this patent is extended or adjusted under 35 U.S.C. 154(b) by 0 days.

(21) Appl. No.: 09/667,721

(22) Filed: Sep. 22, 2000

(30) Foreign Application Priority Data

Sep. 24, 1999 (JP) ..... 11-269624

(51) Int. Cl.[7] ..... H01R 4/48

(52) U.S. Cl. ..... 439/862; 361/408; 439/70; 439/81; 324/158

(58) Field of Search ..... 439/862, 700, 439/762, 66–68, 70–75; 361/725–726; 324/158, 761

(56) References Cited

U.S. PATENT DOCUMENTS 4,341,433 A * 7/1982 Cherian et al. ..... 439/525
4,764,848 A * 8/1988 Simpson ..... 361/408
4,898,539 A * 2/1990 Glover et al. ..... 439/81
5,078,610 A * 1/1992 Matsuoka et al. ..... 439/70
5,247,250 A * 9/1993 Rios ..... 324/158 F
5,545,045 A * 8/1996 Wakamatsu ..... 439/70

* cited by examiner

*Primary Examiner*—P. Austin Bradley
*Assistant Examiner*—Larisa Tsukerman
(74) *Attorney, Agent, or Firm*—Browdy and Neimark, P.L.L.C.

(57) ABSTRACT

The present invention provides a mechanism of a lattice type contact assembly capable of ensuring an appropriate space occupied by an deformation section, and a contact having an appropriate deformation structure conforming to the arrangement in which thin plate contacts are inclined. Contacts having winding elastic deformation sections such that the shape of elastic deformation sections can be selected from many possible alternatives and the relative positional relationship between input sections and output sections can be freely selected are arranged so as to have a certain angle with respect to the x-axis, thereby making it possible to realize a contact assembly with a lattice arrangement of a small pitch.

8 Claims, 8 Drawing Sheets

CONTACT AND CONTACT ASSEMBLY USING THE SAME

BACKGROUND OF THE INVENTION

The present application claims its priority based on Japanese Patent Application No. 11-269624 filed on Sep. 24, 1999, and the disclosure of the present application reflects that of the Japanese patent application.

1. Field of the Invention

The present invention relates to a contact and a contact assembly using the contact, and more particularly to an electrical connection contact used for inspecting circuits of electronic devices and an electronic device connector.

2. Description of Related Art

Conventionally, there have been techniques for inspecting a circuit to be tested or forming a connector by obtaining a contact pressure between an electrically conductive contact and a circuit terminal utilizing the deformation of an elastic body which deforms in the vertical direction and a force generated by the deformation so as to establish an electrical conduction between the contact and the circuit terminal. In such a conventional contact, a coil spring is generally used as the elastic body.

In recent years, however, along with the development in a technique for fabricating an integrated circuit, the circuitry thereof has become extremely miniaturized, and the pitch required in the conductive portion of a contact in a device for testing the circuitry has been also reduced. A connector for connecting various electronic apparatuses with each other has been also miniaturized, and consequently, the pitch required in a terminal portion thereof has been greatly reduced. Thus, a space which can be occupied by an elastic body material in a single contact has become insufficient, thereby making it difficult to realize a contact having an appropriate spring constant. If the amount of elastic deformation is reduced, the range of motion is narrowed. Therefore, an appropriate contact pressure can not be obtained if the manufacturing error of the contact, an error in machine stop position (i.e., the position at which the movement of the machine is stopped) during the contact operation of a device having the contact therein, or the like, occurs.

SUMMARY OF THE INVENTION

The present invention has been made in view of the above-described conventional problems. A first object of the present invention is to provide a contact capable of realizing an appropriate motion stroke and an appropriate contact pressure even when a space between circuit terminals is reduced as in an electronic circuit included in an integrated circuit, or the like.

A second object of the present invention is to provide a contact assembly capable of having an appropriate space occupied by a deformation portion and capable of coping with the manufacturing error of a contact and variations in machine stop position of the circuit terminals.

In order to achieve the above-described objects, the invention according to the first aspect of the present invention is a contact made of a thin-plate-like material, which comprises an input section to be in contact with a terminal of a device to be tested at one end thereof, and an output section to be connected with a terminal of a circuitry at the other end thereof. An elastic deformation section, which elastically deforms with respect to an external force, stands between the input section and the output section, and the elastic deformation section has a beam structure winding in a direction generally perpendicular to a direction in which the elastic deformation section deforms when received the external force. Accordingly, the deformation section with an appropriate length within a volume allowed for one contact can be obtained.

The invention according to the second aspect of the present invention has characteristics as follows. In the above-described contact, the elastic deformation section has a curved beam structure extending symmetrically in both directions perpendicular to the direction in which the external force is applied thereto, and is curved around once or a plurality of times. Accordingly, the deformation section with an appropriate length within a volume allowed for one contact can be obtained.

The invention according to the third aspect of the present invention has characteristics as follows. In the above-described contact, the output section is provided in a fixed section, and a void portion is provided within the fixed section. Accordingly, assembly can be facilitated.

The invention according to the fourth aspect of the present invention is a contact assembly which comprises a plurality of thin-plate-like contacts each including an input section to be in contact with a terminal of an electronic device to be tested at one end thereof; an output section to be connected with a terminal of a testing circuitry at the other end thereof; and an elastic deformation section standing between the input section and the output section. Each of the plurality of contacts is arranged so as to have a predetermined angle with respect to an x-axis of an x-y rectangular coordinate system. Accordingly, contacts including deformation sections, each of which has a length longer than that of a lattice pitch, can be used.

The invention according to the fifth aspect of the present invention has characteristics as follows. In the above-described contact assembly, the x-y rectangular coordinate system is an x-y rectangular coordinate system whose axes are set respectively in row and column directions of a planar lattice formed by arranging the plurality of terminals of the electronic device to be tested or the plurality of terminals of the testing circuitry in a lattice shape, and each of the plurality of contacts is arranged so as to have a predetermined angle with respect to an x-axis of the x-y rectangular coordinate system. Accordingly, contacts including deformation sections, each of which has a length longer than that of a lattice pitch, can be used.

The invention according to the sixth aspect of the present invention has characteristics as follows. In the above-described contact assembly, the plurality of contacts are arranged with respect to the planar lattice in which the plurality of terminals of the electronic device to be tested or the plurality of terminals of the testing circuitry are arranged in a lattice shape so as to be disposed in a crosswise direction with the predetermined angle within a lattice pitch; so as to cover a range of a dimension longer than that of the lattice pitch; and so as not to cause interference between the plurality of contacts. Accordingly, contacts including deformation sections, each of which has a length longer than that of the lattice pitch, can be used in a narrow region without causing interference between the contacts.

The invention according to the seventh aspect of the present invention has characteristics as follows. In the above-described contact assembly, the plurality of contacts are arranged in a crosswise direction within the lattice pitch. Accordingly, contacts including deformation sections, each of which has a length longer than that of the lattice pitch, can be used by effectively utilizing the area of the narrow region.

In the invention according to the eighth aspect of the present invention, the above-described contact assembly further comprises: fixing means which engages with the fixed section of the contact and at least has rectangular holes; guide means of the contact connected to the fixing means, which at least has rectangular holes; and a circuitry having a circuit terminal to be connected with the output section of the contact. Accordingly, the assembly direction of the contacts is fixed, and high precision as to the arrangement of the contacts is achieved.

The invention according to the ninth aspect of the present invention is a circuit testing device which comprises: a contact assembly formed by arranging a plurality of thin-plate-like contacts each including an input section to be in contact with a terminal of an electronic device to be tested at one end thereof; an output section to be connected with a terminal of a testing circuitry at the other end thereof; and an elastic deformation section standing between the input section and the output section; and a testing circuit board connected to the output section. Each of the plurality of contacts is arranged so as to have a predetermined angle with respect to an x-axis of an x-y rectangular coordinate system, and a terminal of a circuit to be tested is contacted with the input section. Accordingly, a highly-integrated circuit can be tested using contacts including deformation sections, each of which has a length longer than that of a lattice pitch.

The invention according to the tenth aspect of the present invention is a connector which comprises: a contact assembly formed by arranging a plurality of thin-plate-like contacts each including an input section to be in contact with a terminal of an electronic device to be tested at one end thereof; an output section to be connected with a terminal of a testing circuitry at the other end thereof; and an elastic deformation section standing between the input section and the output section; and a cable connected to the output section. Each of the plurality of contacts is arranged so as to have a predetermined angle with respect to an x-axis of an x-y rectangular coordinate system. Accordingly, the connection of an electronic device having a highly-integrated connection terminal can be performed using contacts including deformation sections, each of which has a length longer than that of a lattice pitch.

DETAILED DESCRIPTION OF THE PREFERRED EMBODIMENTS

Embodiments of the present invention will be described below with reference to the accompanying drawings.

[Embodiment 1].

Figure 1:
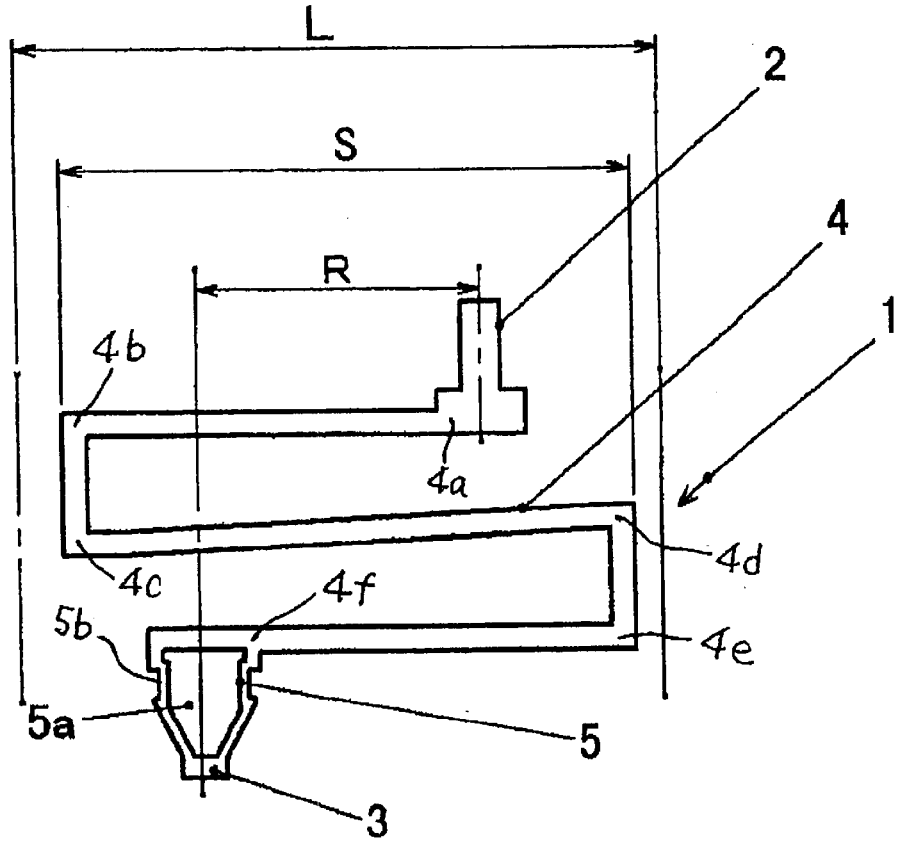
FIG. 1 is a front view of a contact according to Embodiment 1 of the present invention;.
Figure 2:
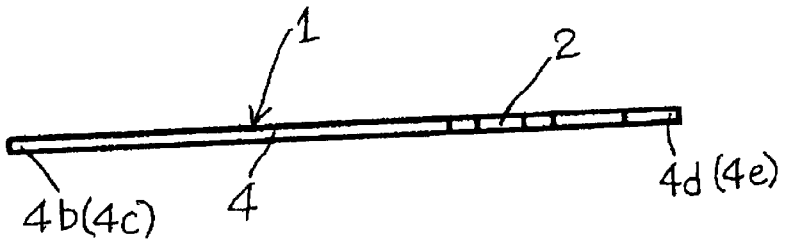
FIG. 2 is a plan view of the contact shown in FIG. 1.

FIG. 1 is a front view of a contact according to Embodiment 1 of the present invention, and FIG. 2 is a plan view of the contact. In FIG. 1, reference numeral 1 denotes a contact made of an electrically conductive material which establishes an electrical conduction between a circuit to be tested and a testing circuit. Reference numeral 2 denotes an input section which is a part of the contact 1 and contacts a terminal of the circuit to be tested, and reference numeral 3 is an output section which is contacted or connected with a terminal of the testing circuit so as to establish an electrical conduction therebetween. Reference number 4 is an elastic deformation section which stands between the input section 2 and the output section 3 and which elastically deforms, when the input section 2 and the terminal of the circuit to be tested are disposed within the range of a certain positional relationship, so as to make a contact therebetween with an appropriate contact force. Reference numeral 5 is a fixed section for accurately maintaining the position and direction of the contact, which includes the FIG. 1 is a front view of a contact according to Embodiment 1 of the present invention, and FIG. 2 is a plan view of the contact. In FIG. 1, reference numeral 1 denotes a contact made of an electrically conductive material which establishes an electrical conduction between a circuit to be tested and a testing circuit. Reference numeral 2 denotes an input section which is a part of the contact 1 and contacts a terminal of the circuit to be tested, and reference numeral 3 is an output section which is contacted or connected with a terminal of the testing circuit so as to establish an electrical conduction therebetween. Reference number 4 is an elastic deformation section which stands between the input section 2 and the output section 3 and which elastically deforms, when the input section 2 and the terminal of the circuit to be tested are disposed within the range of a certain positional relationship, so as to make a contact therebetween with an appropriate contact force. Reference numeral 5 is a fixed section for accurately maintaining the position and direction of the contact, which includes the output section 3 at one end thereof. Recesses 5*b* are formed in the shape of a notch on the respective sides of the fixed section 5. The recesses 5*b* are inserted into and fixed with holes 12 (described later) of a fixed sheet 6 (described later) by mating engagement. A void portion 5*a* is provided within the fixed section 5 so that the fixed section 5 can be deformed when an external force is applied thereto, thereby making it possible to perform press fitting with an appropriate force when a contact assembly is assembled. output section 3 at one end thereof. Recesses 5*b* are formed in the shape of a notch on the respective sides of the fixed section 5. The recesses 5*b* are inserted into and fixed with holes 12 (described later) of a fixed sheet 6 (described later) by mating engagement. A void portion 5*a* is provided within the fixed section 5 so that the fixed section 5 can be deformed when an external force is applied thereto, thereby making it possible to perform press fitting with an appropriate force when a contact assembly is assembled.

In Embodiment 1 of the present invention, the elastic deformation section 4 is structured by a winding beam structure connecting between the input section 2 and the fixed section 5 as shown in FIG. 1. More specifically, as shown in FIG. 1, the beam structure comprises: a first beam portion extending in a substantially horizontal right-to-left direction from a base portion (denoted by 4*a*) of the input section to a first edge portion (denoted by 4*b*) at a predetermined distance from the base portion; a second beam portion extending in a substantially horizontal left-to-right direction from a second edge portion (denoted by 4*c*) immediately under the first edge portion 4*b* to a third edge portion (denoted by 4*d*) at a predetermined distance from the second edge portion; and a third beam portion extending in a substantially horizontal right-to-left direction from a fourth edge portion (denoted by 4*e*) immediately under the third edge portion 4*d* to a base portion (denoted by 4*f*) of the fixed section 5 at a predetermined distance from the fourth edge portion. By the bending deformation of the entire elastic deformation section 4 with such a beam structure, a restoring force is generated. Reference character S denotes an overall length of the contact 1. Reference character R denotes a distance between the input section 2 and the output section 3 in the front view (i.e., the dimension of displacement). An elastic modulus of the elastic deformation section 4 is changed by such a value even when L which will be described later is constant. Therefore, R is determined so that an appropriate restoring force can be obtained. In the case where R is not 0, i.e., in the case where there exists a predetermined dimension of displacement between the input section 2 and the output section 3 (i.e., the input section 2 and the output section 3 are not disposed along the same vertical line), when the beam structure is deformed by an external force in the vertical direction applied from the input section 2, a force in a direction substantially perpendicular to the input direction of the above-described external force is generated between the input section 2 and the output section 3 positioned at the respective ends of the contact 1, possibly causing displacement between the input section 2 and the output section 3. Therefore, R is not preferably zero. Reference character L refers to a limit dimension which can be allowed as an overall length of the contact 1 in the present invention (i.e., the possible maximum dimension of S).

FIG. 2 is a plan view of the contact 1 according to Embodiment 1. As can be seen from FIGS. 1 and 2, the contact 1 of this embodiment has a structure obtained by cutting the input section 2, the output section 3, and the elastic deformation section 4 out from a thin plate material. The characteristics of the present invention are as follows. First, when a contact assembly is formed by using the contact 1, the overall length S of the contact 1 can be made much greater than a lattice pitch P of the input sections 2 and the output sections 3. Second, the value of the displacement dimension R can be selected within the limited range S. Insulation coating is applied to nearly the entire surface of the contact 1 (excluding the input section 2 and the output section 3 which are brought into contact with the terminals of other circuits) so that an insulating property is maintained.

Figure 3:
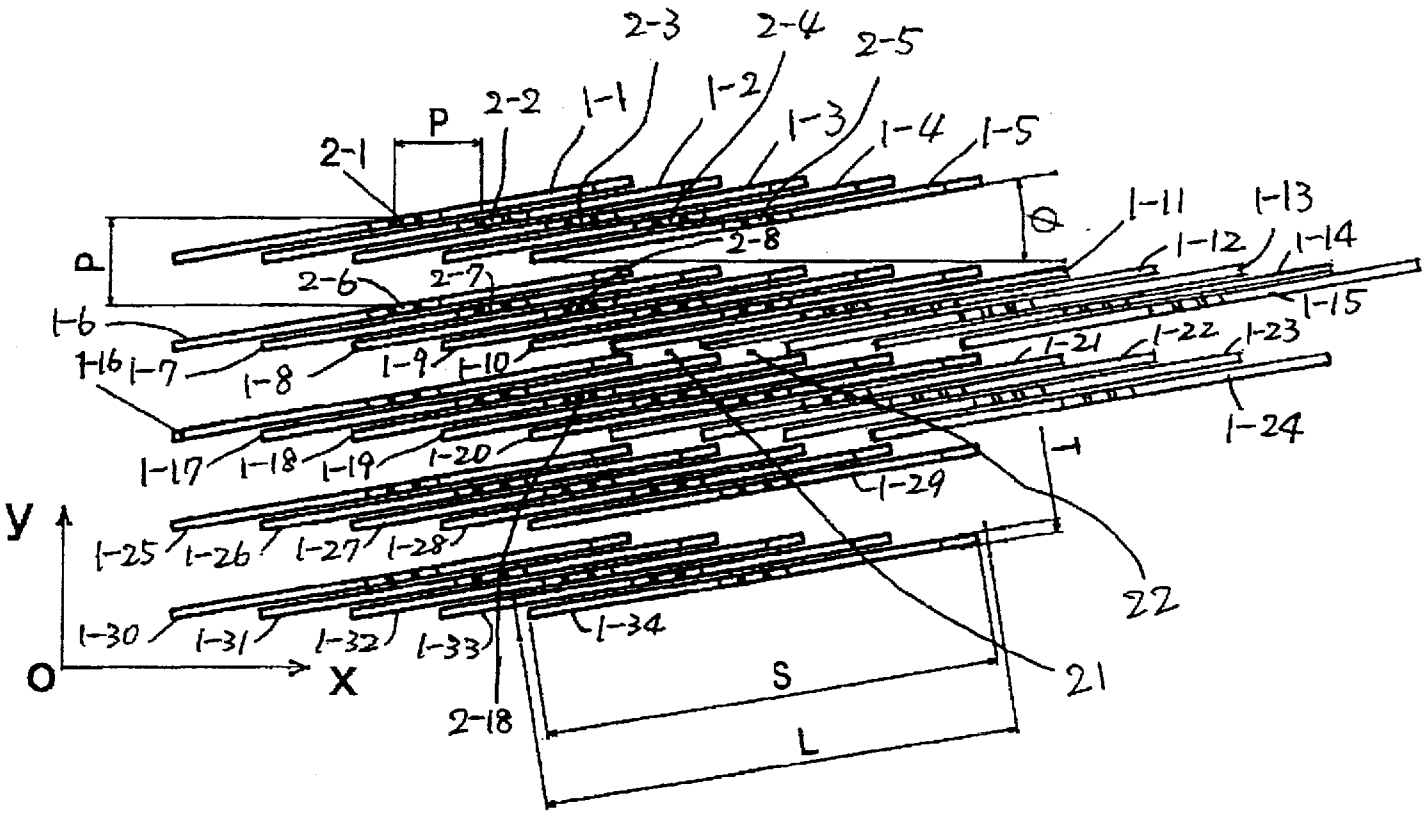
FIG. 3 is a plan view showing an arrangement of the contacts 1 according to Embodiment 1 of the present invention.
Figure 4:
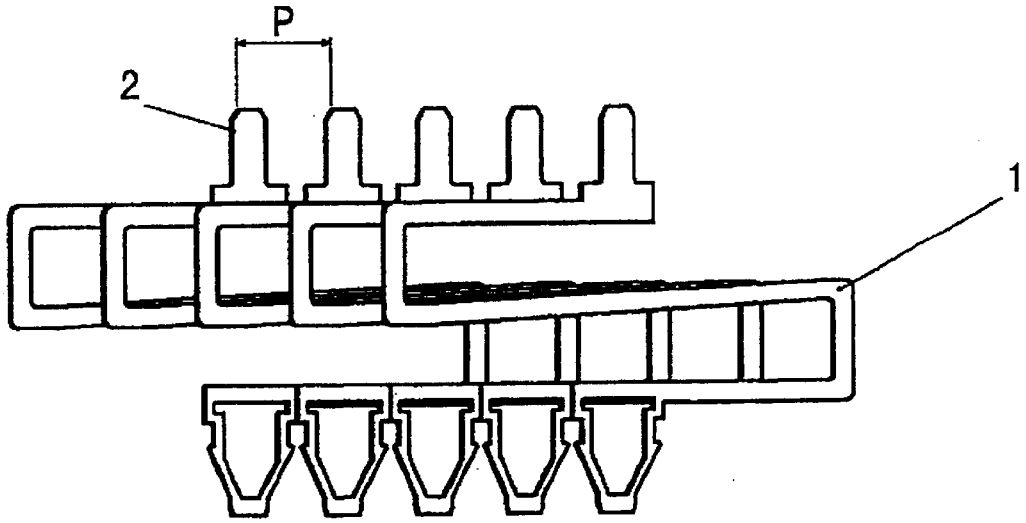
FIG. 4 is a front view of the arrangement of the contacts 1 shown in FIG. 3.

FIG. 3 is a plan view showing an arrangement of a plurality of contacts 1 according to Embodiment 1 which are disposed so as to form a contact assembly. FIG. 4 is a front view of the arrangement of the plurality of contacts 1 shown in FIG. 3. Since the plurality of contacts 1 are arranged in FIGS. 3 and 4, a plurality of the input sections 2 and a plurality of the output sections are arranged. The input sections 2 and the output sections 3 are arranged in the x-axis direction and the y-axis direction of an x-y rectangular coordinate system. The input section 2 and the output section 3 are arranged with a pitch P in both of the x-axis and y-axis directions. The x-y rectangular coordinate system corresponds with (i.e., is equal to) an x-y rectangular coordinate system whose axes are respectively set in a row direction and in a column direction of a planar lattice formed by arranging a plurality of terminals of an electronic device to be tested or a plurality of terminals in a testing circuitry in a lattice shape. The contacts 1 are arranged so that the pitch P in the x-axis or y-axis direction of the above-described x-y rectangular coordinate system corresponds to the pitch of the above-described planar lattice formed by arranging the plurality of terminals of the electronic device to be tested or the plurality of terminals in the testing circuitry in a lattice shape.

In FIG. 3, an angle $\ominus$ is an angle made by a straight line connecting between the respective ends of the contact 1 with a thin-plate-like structure in the longitudinal direction (i.e., the crosswise direction in FIGS. 1 and 2 and the x-axis of the x-y rectangular coordinate system. The angle $\ominus$ indicates that it is also possible to arrange the contact 1 in the y-axis direction without causing interference between the contacts 1 as long as the relationship is $S\sin\ominus<L\sin\ominus<P$ is satisfied. More specifically, the above-described angle $\ominus$ indicates that the contact 1 each have a thin-plate-like structure are arrange by being inclined at the angle of $\ominus$ with respect to the x-axis of the x-y rectangular coordinate system in order to arrange the input sections 2 and the output sections 3 in the x-axis and y-axis directions of the x-y rectangular coordinate system, respectively. Each of L shown in FIGS. 1 and 3 and T shown in FIG. 3 refers to a maximum dimension which does not cause interference in a state where the contacts 1 are arranged so that the input sections 2 and the output sections 3 are arranged in a lattice shape with the pitch P as described above.

The arrangement of the contacts 1 shown in FIG. 3 will be described below is greater detail. In FIG. 3, the contacts 1 are individually denoted by different reference numerals for an illustration purpose. The five contacts shown in the top row are denoted, from the left to the right, by 1-1, 1-2, . . . 1-5, respectively. The ten contacts shown in the second row from the top are denoted, from the left to the right, by 1-6, 1-7, . . . 1-15, respectively. The nine contacts shown in the third row from the top are denoted, from the left to the right, by 1-16, 1-17, . . . 1-24, respectively. The five contacts shown in the fourth row from the top are denoted, from the left of the right, by 1-25, 1-26, . . . 1-29, respectively. The five contacts shown in the fifth row from the top are denoted, from the left to the right, by 1-30, 1-31, . . . 1-34, respectively. The input sections respectively corresponding to the contacts 1-1, 1-2, . . . 1-34 are denoted by 2-1, 2-2, . . . 2-23, respectively. In order to avoid unclarity, only a part of those reference numerals for the input sections are shown in FIG. 3, and the others reference numerals are omitted. In FIG. 3, the contacts 1-1 to 1-34 are arranged with being inclined by the angle of $\ominus$ with respect to the x-axis so that the input sections 2 and the output sections 3 are arranged in the x-axis and y-axis directions of the x-y rectangular coordinate system so as to form a lattice shape with a pitch of P. Only a small space is formed between the contact adjacent to each other (e.g., between 1-1 and 1-2). By arranging the contacts 1-1 to 1-34 as described above, a plurality of contacts can be placed within the lattice pitch formed by arranging the input sections 2-1 to 2-34 due to the thin plate shape of the contact 1. Accordingly, the plurality of contacts are respectively disposed in a crosswise direction within the lattice pitch. For example, between the input section 2-8 and the input section 2-18 which is displaced by one pitch in the downward y-axis direction, there exist the contacts 1-8, 1-9, 1-10, 1-11, 1-16, and 1-17. In other words, six contacts can be disposed within one pitch P of the lattice in this embodiment. Of course, by further reducing the thickness of a plate material forming the contact, a greater number of contacts can be disposed within a pitch P of the lattice.

The contacts 1-8, 1-9, 1-10, 1-11, 1-16, and 1-17 are arranged so as to have the angle of e and the extend in a crosswise direction over a distance longer than that of the lattice pitch. If a group of contacts 1-6 to 1-15 in the second row from the top and a group of contact 1-16 to 1-24 in the third row from the top are closely watched, the contact 1-16 belonging to the group of contacts in the third row from the top is positioned on the left of the contact 1-12 in the second row from the top along the extension of the contact 1-12, and the contact 1-17 belonging to the group of contacts in the third row from the top is positioned on the left of the contact 1-13 in the second row from the top along the extension of the contact 1-13. A space 21 is thus formed between the contact 1-12 and the contact 1-16, and a space 22 is thus formed between the contact 1-13 and the contact 1-17. Accordingly, the contacts are arranged without causing interference between contacts adjacent to each other in the longitudinal direction and the width direction. When the longitudinal dimension of the contact 1 is maximized, the spaces 21 and 22 can be made very small. Thus, the contacts are arranged substantially over (i.e., so as to fill up) the entire area of a lattice region where the input sections 2-1 to 2-34 are arranged (this is also a region where a plurality of terminals of an electronic device to be tested or a plurality of terminals in a testing circuitry are arranged in a lattice shape). Therefore, even when the degree of integration of an integrated circuit is increased and the circuitry thereof is thus extremely miniaturized, it is possible to establish connections to the terminals by efficiently utilizing such a narrow area.

The contacts 1 are arranged with being inclined by the angle of ⊖ with respect to the x-axis in order to realize a deformation section having a length longer than that of a lattice pitch P while avoiding interference between the contacts adjacent to each other. It is preferred that the allowable dimension T of the contact 1 in the thickness direction is much smaller than the dimension of the pitch P. Although it may be necessary to accommodate a wafer terminal pitch P of about 150 microns in a wafer burn-in test, at present, materials such as an iron type spring steel having a thickness of 10–20 microns are commercially available. Therefore, the reduction to practice of an embodiment of the present invention is not restricted by the material of the contact 1. It is obvious that a contact with a dimension S greater than that of the pitch P can be obtained by using a raw material with a thickness of P/N (N is a positive number) for the contact 1.

Figure 5:
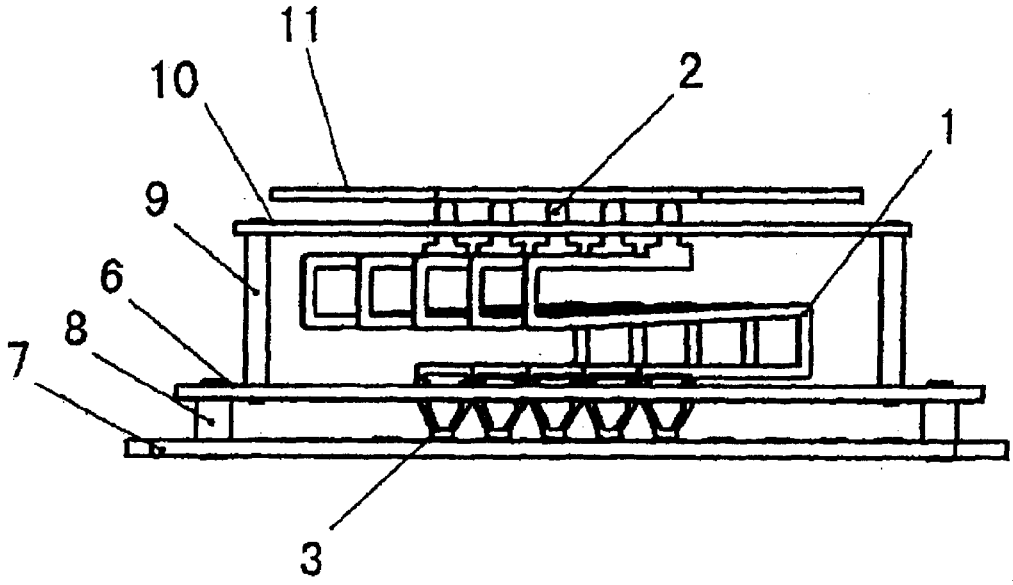
FIG. 5 is a front view of a contact assembly according to Embodiment 1 of the present invention.
Figure 6:
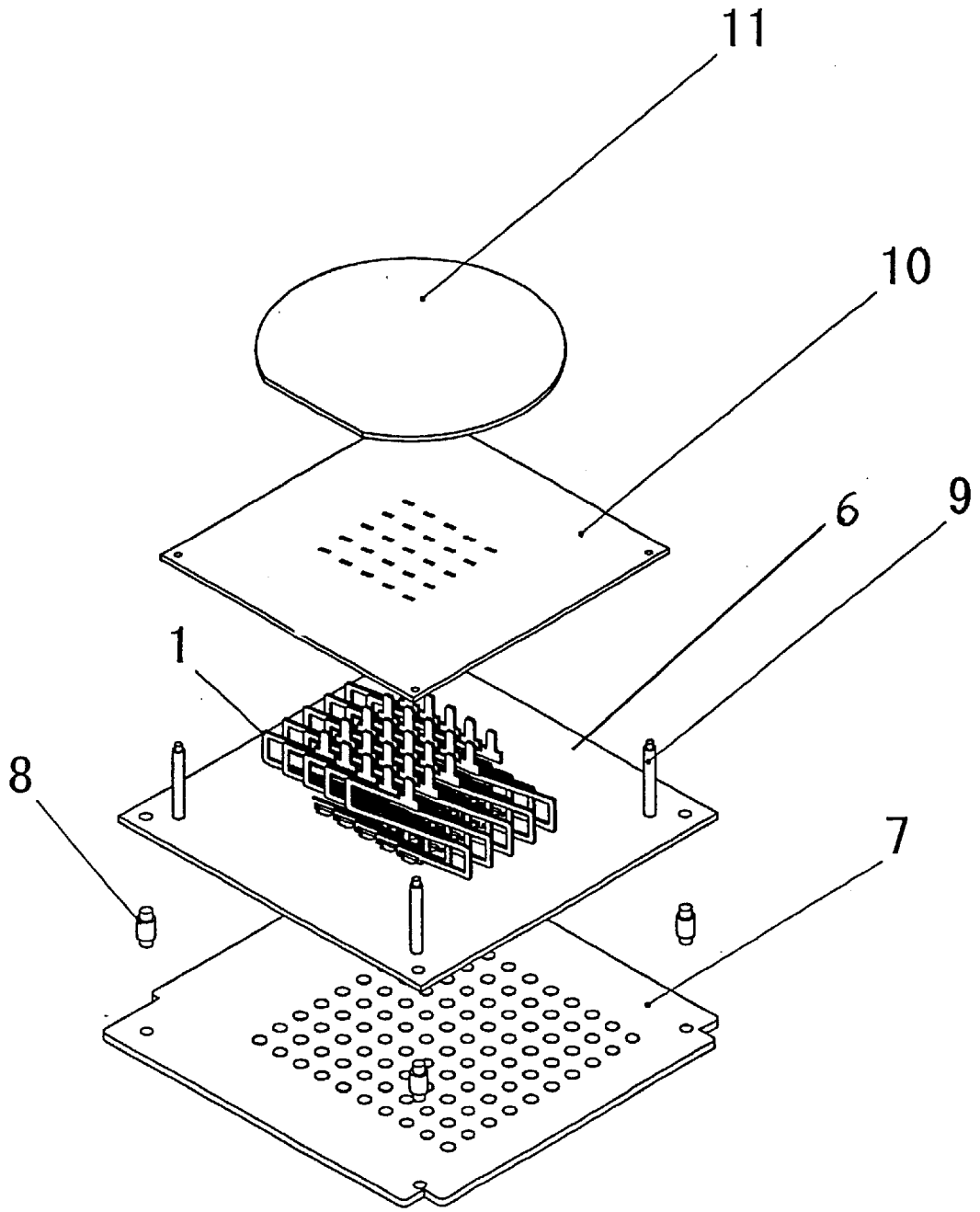
FIG. 6 is an exploded view of the contact assembly shown in FIG. 5.
Figure 7:
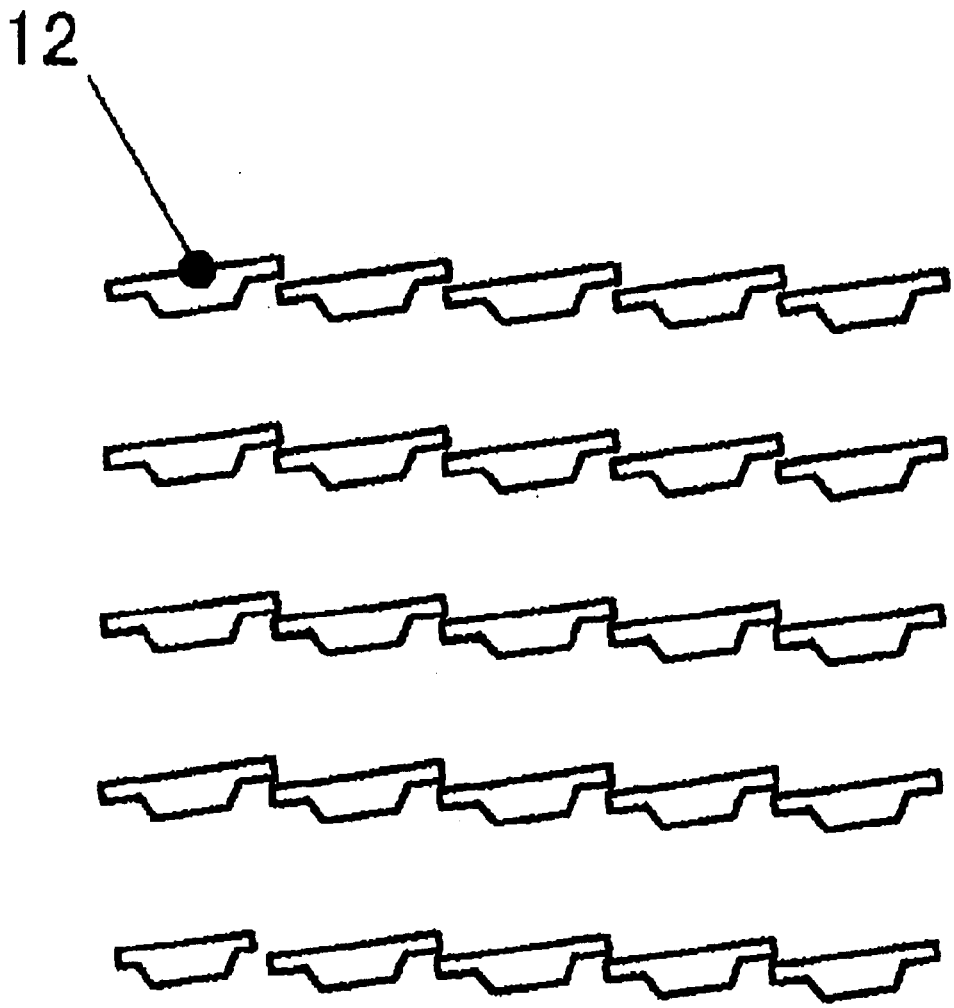
FIG. 7 is a diagram showing holes of a fix sheet.
Figure 8:
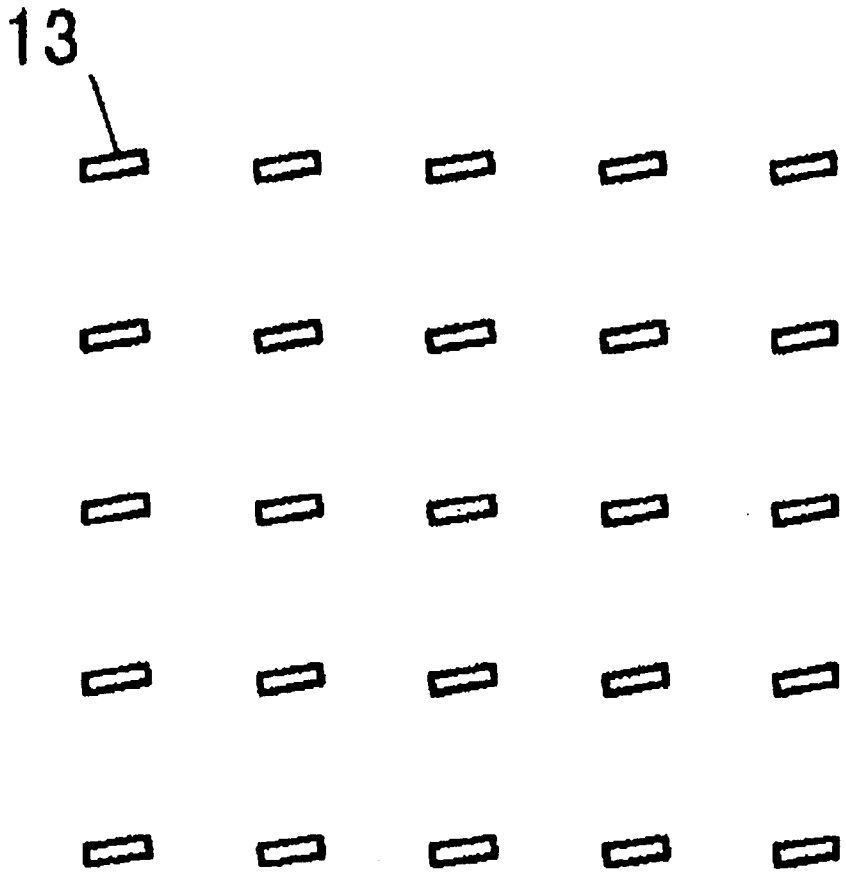
FIG. 8 is a diagram showing holes of a guide sheet.

FIG. 5 is a general front view showing a testing device which employs the contact assembly of Embodiment 1 for the connection test of an integrated circuit. FIG. 6 is an exploded view of the testing device shown in FIG. 5. FIG. 7 is a diagram illustrating holes of a fixing sheet, and FIG. 8 is a diagram illustrating holes of a guide sheet. In FIGS. 5 and 6, reference numeral 6 denotes a fixing sheet; reference numeral 7 denotes a printed circuit board; reference numeral 8 denotes a coupling post; reference numeral 9 denotes a supporting post; reference numeral 10 denotes a guide sheet; and reference numeral 11 denotes a wafer. The fixing sheet 6 is made of an insulating material, and includes holes 12 each having a shape such as that obtained by joining an inclined rectangle and an inclined trapezoid together. The fixed sections 5 of the contacts 1 are inserted into and coupled to the holes 12 while maintaining the mating relationship therewith. The trapezoidal portion of the hole 12 plays a role of facilitating the insertion of the fixed section 5 and the rectangular portion of the holes 12 plays a role of preventing the contact from rotating after the above described coupling. The printed circuit board 7 and the fixing sheet 6 are coupled together via the coupling posts 8 so as to keep a certain positional relationship therebetween. The rectangular portion is inclined by an angle of ⊖ with respect to the x-axis. The fixing sheet 6 and the guide sheet 10 are connected and fixed to each other via the supporting posts 9. The guide sheet 10 includes rectangular holes 13 shown in FIG. 8, each of which is inclined by an angle of ⊖ with respect to the x-axis. The input sections 2 of the contacts 1 are inserted into the holes 13. The rectangular holes 13 and the input sections 2 are in an appropriate mating relationship with each other so that there is no force preventing the movement of the contacts 1. Thus, the rectangular holes 13 provide a guiding function to prevent bending, falling, etc. of the contacts 1, thereby ensuring an appropriate precision.

Reference numeral 11 denotes a wafer having a circuitry to be tested. FIG. 5 shows a state in which the input sections 2 of the contacts 1 and terminals (not shown) of the wafer are in contact with each other and the elastic deformation sections 4 of the contacts 1 are compressively deformed downwardly, thereby creating an appropriate contact force. When testing the wafer 11, in general, one wafer 11 is conveyed toward the input sections 2 of the contacts 1, and such a movement of the wafer 11 realizes a contact between the terminals of the wafer 11 and the input sections 2 of the contacts 1. At this time, although the wafer 11 presses down the input sections 2 of the contacts 1 in the vertical direction, thereby compressively deforming the elastic deformation sections 4 of the contacts 1, a slight force in the lateral direction (horizontal direction) is acted upon the input sections 2 during this compression. This is because the displacement distance R between the input section 2 and the output section 3 is set to a predetermined value as described above in connection with the configuration of the contact 1. Because of this displacement distance, when the elastic deformation sections 4 are deformed by an external force applied to the input sections 2 in the vertical direction, a force in a direction generally perpendicular to the input direction of the above-described external force (i.e., in the horizontal direction) is created between the input sections 2 and the output sections 3 which are disposed at the respective ends of the contacts 1, thereby possibly causing a displacement between the input sections 2 and the output sections 3. The output sections 3 are fixed to the fixing sheet 6 by the fixed sections 5, and the lower edges thereof are connected to the printed circuit board 7. Therefore, each of the output sections 3 is in the stationary state. Thus, the above-described displacement occurs at the side of the input sections 2. Thus, the input sections 2 are slightly shifted with respect to the terminals of the wafer 11 with which the input sections 2 are in contact, thereby effecting a scratching movement. Consequently, dust and dirt existing between those members are removed, or where an insulating material is left unremoved at the terminal portion, the insulating material is stripped off, or the like.

[Embodiment 2]

Figure 9:
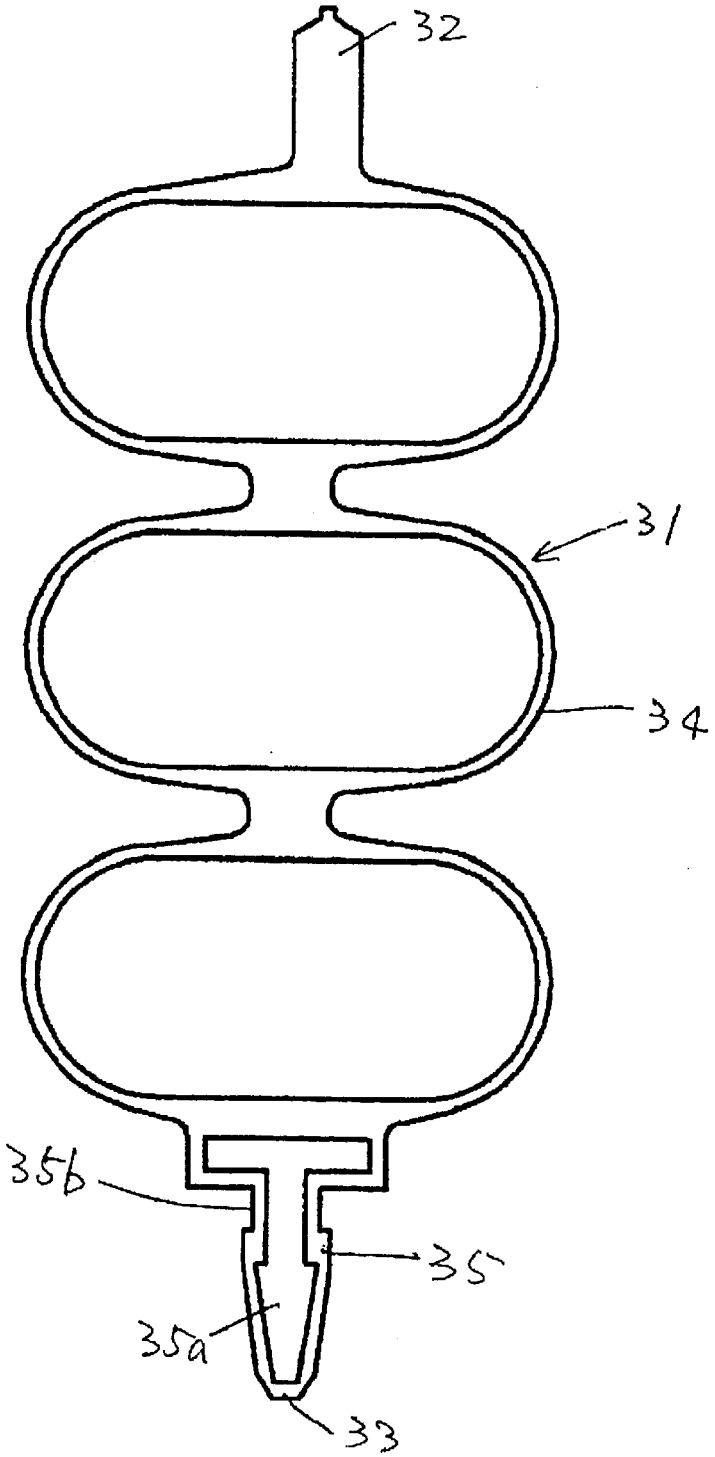
FIG. 9 is a front view of a contact according to Embodiment 2 of the present invention.

FIG. 9 is a front view showing another exemplary configuration of a contact according to Embodiment 2 of the present invention. In FIG. 9, reference numeral 31 denotes a contact made of an electrically conductive material which establishes an electrical conduction between a circuit to be tested and a testing circuit. Reference numeral 32 denotes an input section which is a part of the contact 31 and contacts a terminal of the circuit to be tested, and reference numeral 33 is an output section which is contacted or connected with a terminal of the testing circuit so as to establish an electrical conduction therebetween. Reference numeral 34 is an elastic deformation section which stands between the input section 32 and the output section 33 and which elastically deforms, when the input section 32 and the terminal of the circuit to be tested are disposed within the range of a certain positional relationship, so as to establish a contact therebetween with an appropriate contact force. Reference numeral 35 is a fixed section for accurately maintaining the position and direction of the contact 31, which includes the output section 33 at one end thereof. Recesses 35*b* are formed in the shape of a notch on the respective sides of the fixed section 35. The recesses 35*b* are inserted into and fixed with the holes 12 of the fixing sheet 6 by mating engagement. A void portion 35*a* is provided within the fixed section 35 so that the fixed section 35 can be deformed when an external force is applied thereto, thereby making it possible to perform press fitting with an appropriate force when a contact assembly is assembled.

In Embodiment 2 of the present invention, as shown in FIG. 9, the elastic deformation section 34 is structured by a plurality of curved beam structures (three in the figure) connecting between the input section 32 and the fix section 35. The beam structure extends symmetrically in both directions perpendicular to (i.e., the opposite directions which are generally at right angles with respect to) the direction in which the external force is applied thereto, and is curved around once or a plurality of times. More specifically, this beam structure has the shape of an ellipse (a shape similar to a track in an athletics stadium). By the bending deformation of the entire elastic deformation section 34 having such a beam structure, a restoring force is generated. The function of the contact 31 and a method for arranging the contacts 31 are the same as those in Embodiment 1 described above. As in Embodiment 1 described above, insulation coating is applied to nearly the entire surface of the contact 31 (excluding the input section 32 and the output section 33 which are brought into contact with the terminals of other circuits) so that an insulating property is maintained.

As described above, such a winding deformation structure that it is possible to select a shape of the deformation section of the contact from many possible alternatives and to freely select relative positional relationship between the input section and the output section is employed in embodiments of the present invention.

In order to form a contact assembly, fixing means for maintaining the arrangement direction of each contact is employed. Guide means is provided in the vicinity of the input section of the contact to be contacted with an electronic device, thereby achieving a high accuracy. By arranging the above-described contact so as to have a certain angle of inclination with respect to a coordinate axis of the rectangular coordinate system, a contact assembly having a lattice arrangement with a small pitch of the input sections and the output sections is realized.

According to the present invention, the contacts in the form of thin plates are arranged with a certain angle of inclination with respect to the coordinate axis of the lattice formed by circuit terminals of the circuit to be tested, and even when each contact has a length such that the contact extends over a plurality of pitches of the above-described lattice, the contact would not interfere with other contacts. Thus, the contact has a certain width and thickness in the deformation direction with a sufficient dimension in the lateral direction so as to increase the dimension which is involved in flexure.

As described above, according to the present invention, it is possible to provide a contact having an appropriate deformation structure which conforms to the arrangement in which thin plate contacts are inclined. Therefore, according to the present invention, in the case where a distance between circuit terminals is reduced as in an electronic circuit included in an integrated circuit, it is possible to solve the problems that a sufficient material arranging space does not exist in the deformation section of the contact and that an appropriate motion stroke and an appropriate contact pressure are not obtained. Also, it is possible to realize a contact assembly structured by a highly-accurate lattice arrangement having a large stop motion margin which can cope with the manufacturing error of the contact and variations in machine stop position of the circuit terminals.

Such a contact assembly can be used to realize a high-density connector which can be used with a connection having a high terminal integration density.

Although the case where the contact assembly is used as a testing device of an integrated circuit is described above, the contact assembly can be effectively used in any situations in the fields of art where connection between integrated terminals is required. For example, it is possible to realize a high-density connector which can be used with a connection having a high terminal integration density using the contact assembly of the present invention. In such a case, the input section 2 of the contact 1 is a plug of the connector, and the output section 3 of the contact 1 is connected to a cable.

Although a few preferred embodiments of the present invention have been shown and described, it will be appreciated by those skilled in the art that changes may be made in these embodiments without departing from the principles and sprit of the invention, the scope of which is defined in the claims and their equivalents.

What is claimed is:

1. A contact assembly comprising:

a plurality of thin plate contacts, each thin plate contact including an input section adapted to be in contact with a terminal of an electronic device to be tested at one end thereof;

an out put section adapted to be connected to a terminal of a testing circuit at the other end thereof; and an elastic deformation section located between the input section and the output section;

wherein the plurality of terminals of the electronic device to be tested or the plurality of terminals of the testing circuit are arranged in a lattice shape in a planar x-y rectangular coordinate system, wherein the elastic deformation section of each of the plurality of contacts has a planar length which is longer than the length of a diagonal line of the lattice;

wherein the elastic deformation section of each of the plurality of contacts is arranged so as to extend in a direction of a predetermined angle which is not the same as the angle of the diagonal line of the lattice with respect to an x-axis of an x-y- rectangular coordinate system;

wherein the elastic deformation section of each of the plurality of contacts is arranged so as to extend beyond an area of the lattice to which the contact belongs to a next lattice by crossing the lattice pitch; and wherein, between the plurality of terminals of the electronic device to be tested or the plurality of terminals of the testing circuit forming a lattice, there are a plurality of elastic deformation sections comprising a plurality of contacts disposed in a manner that they extend in a crosswise direction in an angle which is not the same as the angle of the diagonal line of the lattice to which the contact belongs with respect to an x-axis of an x-y-rectangular coordinate system, and that they extend to a length longer than a diagonal line of the lattice, and they extend such that they do not interfere with one another.

2. The contact assembly according to claim 1 wherein the x-y rectangular coordinate system is an x-y rectangular coordinate system in which the axis are set respectively in row and column directions of a planar lattice formed by arranging the plurality of terminals of the electronic device to be tested or the plurality of terminals of the testing circuitry in a lattice shape; and wherein each of the plurality of contacts is arranged so as to have a predetermined angle with respect to an x-axis of the x-y rectangular coordinate system.

3. The contact assembly according to claim 1 wherein the plurality of contacts are arranged in a crosswise direction within the lattice pitch.

4. The contact assembly according to claim 2 wherein the plurality of contacts are arranged in a crosswise direction within the lattice pitch.

5. The contact assembly according to claim 1 further comprising:

fixing means which engages with a fixed section of the contact, which fixing means has rectangular holes;

guide means of the contact connected to the fixing means, which guide means has a corresponding rectangular hole on the fixing means; and circuitry having a circuit terminal adapted to be connected to the output section of the contact.

6. The contact assembly according to claim 2 further comprising:

fixing means which engages with a fixed section of the contact, which fixing means has rectangular holes;

guide means of the contact connected to the fixing means, which guide means has a corresponding rectangular hole on the fixing means; and circuitry having a circuit terminal adapted to be connected to the output section of the contact.

7. A circuit testing device comprising:

a contact assembly formed from a plurality of thin plate contacts, each of said contacts including an input section adapted to be in contact with a terminal of an electronic device to be tested at one end thereof and an output section adapted to be connected to a terminal of a testing circuit at the other end thereof, and an elastic deformation section located between the input section and the output section; and a testing circuit board connected to the output section;

wherein the elastic deformation section of each of the plurality of contacts is arranged so as to extend in a direction of a predetermined angle which is not the same as the angle of the diagonal line of the lattice to which the contact belongs with respect to an x-axis of an x-y-rectangular coordinate system;

wherein the elastic deformation section of each of the plurality of contacts is arranged so as to extend beyond an area of the lattice to which the contact belongs to a next lattice by crossing the lattice pitch;

wherein a terminal of a circuit to be tested is contacted with the input section; and wherein between the plurality of terminals of the electronic device to be tested or the plurality of terminals of the testing circuit forming a lattice, there are a plurality of elastic deformation section of a plurality of contacts which are disposed in a manner such that they extend in a crosswise direction with the predetermined angle which is not the same as the angle of the diagonal line of the lattice to which the contact belongs with respect to an x-axis of an x-y rectangular coordinate system, that they extend to a length longer than the length of the diagonal line of a lattice, and that they extend so that they do not interfere with each other.

8. A connector, comprising:

a contact assembly formed by arranging a plurality of thin plate contacts, each thin plate contact including an input section adapted to be in contact with a terminal of an electronic device to be tested at one end thereof, an output section adapted to be connected with a terminal of a testing circuit to the other end thereof, and an elastic deformation section located between the input section and the output section;

wherein the elastic deformation section of each of the plurality of contacts has a planar length which is longer than the length of a diagonal line of a lattice;

wherein the elastic deformation section of each of the plurality of contacts is arranged so as to extend in a direction of an angle which is not the same as the angle of the diagonal line of the lattice to which the contact belongs with respect to an x-axis of an x-y rectangular coordinate system;

wherein the elastic deformation section of each of the plurality of contacts is arranged so as to extend beyond an area of the lattice to which the contact belong to a next lattice by crossing the lattice pitch;

wherein a terminal of a circuit to be tested is contacted with the input section;

wherein the plurality of terminals of the electronic device to be tested or the plurality of terminals of the testing circuit are arranged in a lattice shape in a planar x-y rectangular coordinate system; and wherein between the plurality of terminals of the electronic device to be tested or the plurality of terminals of the testing circuit forming a lattice, there are a plurality of elastic deformation section of a plurality of contacts which are disposed in a manner that they extend in a crosswise direction in an angle which is not the same as the angle of the diagonal line of the lattice to which the contact belongs with respect to an x-axis of an x-y rectangular coordinate system, that they extend to a length which is longer than the length of a diagonal line of a lattice, and that they extend under a condition such that they do not interfere with each other.

* * * * *